United States Patent [19]

Griggs et al.

[11] Patent Number: 4,553,680

[45] Date of Patent: Nov. 19, 1985

[54] DISPLAY CASE

[75] Inventors: James S. Griggs, Branford, Conn.; Laura K. Lada-Mocarski, 123 York St., New Haven, Conn. 06510

[73] Assignee: Laura K. Lada-Mocarski, New Haven, Conn.

[21] Appl. No.: 643,474

[22] Filed: Aug. 23, 1984

Related U.S. Application Data

[63] Continuation of Ser. No. 511,656, Jul. 7, 1983, abandoned.

[51] Int. Cl.[4] ..... B65D 6/00

[52] U.S. Cl. ..... 220/4 F; 206/45.34

[58] Field of Search ..... 220/4 F, 45.34

[56] References Cited

U.S. PATENT DOCUMENTS

| | | | |
|---|---|---|---|
| 390,794 | 10/1888 | Nacke . | |
| 584,584 | 6/1897 | Ganter . | |
| 690,874 | 1/1902 | Powers . | |
| 780,105 | 1/1905 | Jaeger . | |
| 825,564 | 7/1906 | Bangs . | |
| 876,617 | 1/1908 | Bierend . | |
| 991,571 | 5/1911 | Weinstock . | |
| 1,030,444 | 6/1912 | Zabel . | |
| 1,828,088 | 10/1931 | Robinson | 220/4 F |
| 2,028,058 | 1/1936 | Geyer . | |
| 2,501,980 | 3/1950 | Wolfe | 220/4 F |
| 2,919,045 | 12/1959 | Waugh et al. | 220/4 F |
| 2,989,226 | 6/1961 | Swartz | 220/4 F |
| 3,182,846 | 5/1965 | La Kaff | 220/4 F |
| 3,450,293 | 6/1969 | Seda et al. | 220/4 F |
| 3,651,975 | 3/1972 | Callan | 220/4 F |
| 3,692,204 | 9/1972 | Provi et al. | 220/4 F |

*Primary Examiner*—Joseph Man-Fu Moy

*Attorney, Agent, or Firm*—Costas, Montgomery & Dorman

[57] ABSTRACT

A transparent display case comprising upper and lower panels, and four side panels, where the upper and lower panels are grooved to receive edges of the side panels, and four rod-like members extend between the upper and lower panels at the vertical edges of the side panels and hold the edges of the side panels in the grooves.

6 Claims, 3 Drawing Figures

DISPLAY CASE

This is a continuation of application Ser. No. 511,656, filed July 7, 1983, now abandoned.

FIELD OF THE INGENTION

This invention relates to display cases and more particularly relates to an easily demountable display case which does not require any structural corner braces.

BACKGROUND OF THE INVENTION

In many exhibitions rare or delicate works are displayed; for example, rare manuscripts are often exhibited for public viewing. Generally such articles are placed in large floor mounted display cases. Such display cases are generally permanently assembled and cannot be taken apart for storage and/or shipping if used on a traveling exhibition, or when the exhibition terminates.

Most display cases comprise a top and four side panels which are held in the configuration by pre-formed corner pieces, as exemplified in U.S. Pat. No. 1,030,444. Such corner pieces may be expensive, detract from the appearance of the case, require permanent assembly of the case, and/or decrease the viewing area.

Accordingly, the present invention provides a new and improved transparent display case which is easily fabricated for display purposes and easily disassembled for either storage or shipment.

SUMMARY OF THE INVENTION

A display case embodying the invention comprises six panels; top, bottom, and four side panels forming a parallelpiped. The top and side panels are transparent and the bottom panel may be transparent. A continuous groove of essentially rectangular shape is defined in the facing surfaces of each of the top and bottom panels. The side panels may be all of the same size or may be in pairs of different length, but in either case are the same height. Apertures are defined at the corners of the rectangular grooves.

In assembly rod-like securing members are passed through the lower apertures in the bottom plate. The side panels are fitted into the groove between the securing members in the bottom panel and the upper panel is positioned to receive the upper edges of the side panels. The upper panel is then secured to the rod-like members. The rod-like members have a diameter substantially the same as the width of the side panels and rod-like member is essentially in abutting relation with the vertical edges of the side panels. This provides a substantially labyrinth seal against entrance of dirt and other foreign particles.

An object of this invention is to provide a new and improved display case.

Another object of this invention is to provide a new and improved display case which is easily fabricated and easily disassembled for storage or shipping.

A further object of this invention is to provide a new and improved demountable display case which maximizes viewing area.

The features of the invention which are believed to be novable are particularly pointed out and distinctly claimed in the concluding portion of this specification. The invention, however, together with further objects and advantages thereof, may best be appreciated by reference to the following detailed description taken in conjunction with the drawings.

DESCRIPTION OF THE PREFERRED EMBODIMENT OF THE INVENTION

A display case 10 embodying the invention comprises a bottom panel 11, a top panel 12, a pair of facing side panels 13 and 14, and a second pair of facing side panels, 15 and 16. All of the side panels 13–16 are of the same height. The two pairs of side panels may be of different length depending upon the size of the case desired.

Figure 1:
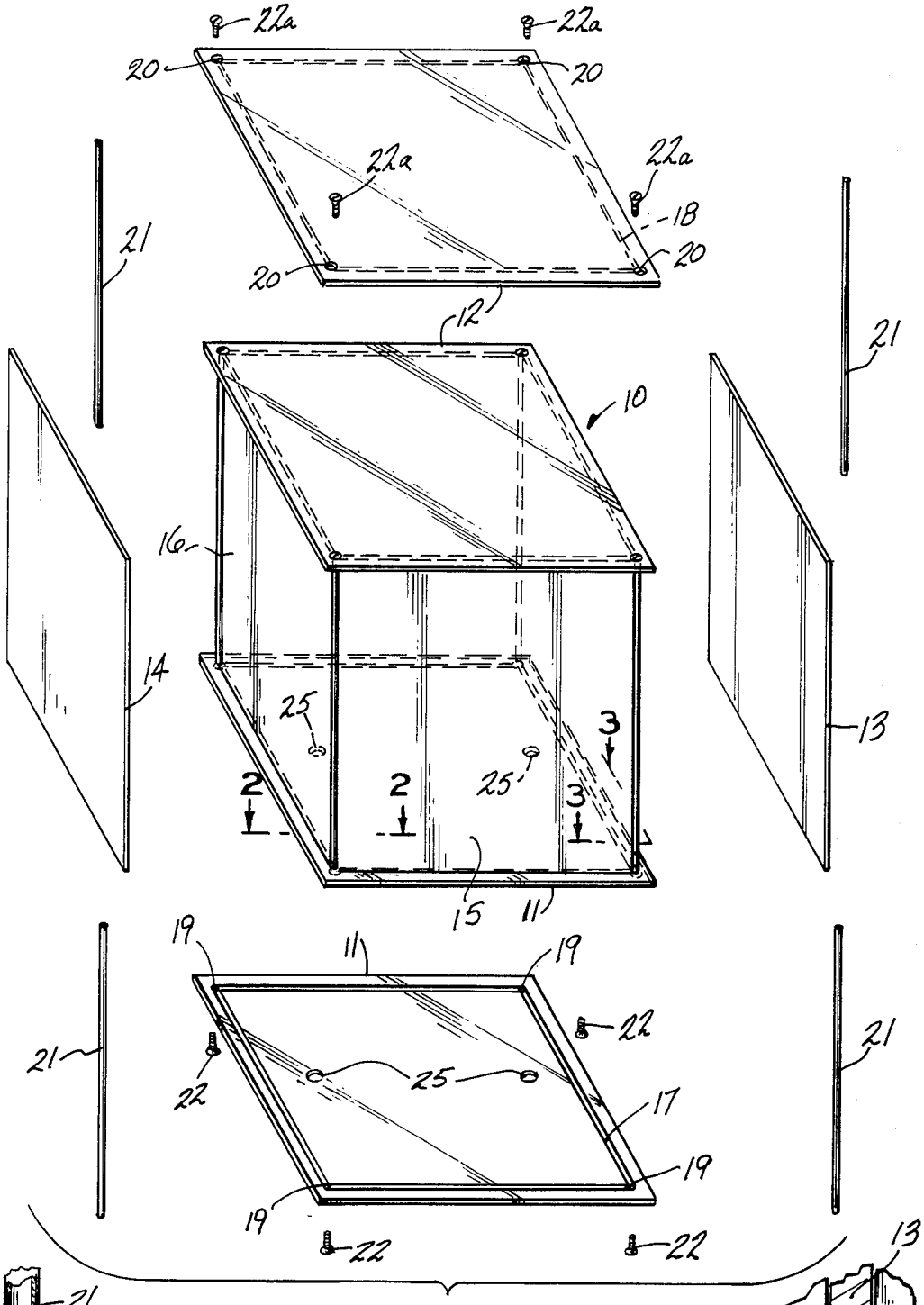
FIG. 1 is a perspective, and an exploded view of a display case embodying the invention.
Figure 2:
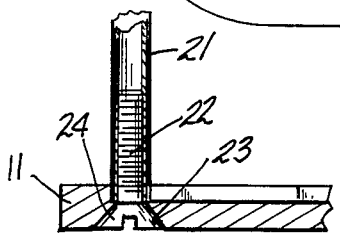
FIG. 2 is a view seen in the plane of lines 2—2 of FIG. 1.

A continuous rectangular groove 17 is defined in the upper surface of lower panel 11 and a continuous rectangular groove 18 is defined in the undersurface of upper panel 12. The two rectangular grooves are preferably indentical in dimension. Apertures 20 are defined in each corner of the grooves 18 and 19. A plurality of tubular, rod-like members 21, having essentially the same height as the side panels, are threaded at each end to receive screws 22 and **23*a* therein. The apertures 19 and 20 are counterbored, as shown by the reference number 23 in FIG. 2 to receive the heads 24 of the screws 22. Apertures 25 are defined in bottom panel 11** to permit the display case to be mounted to a pedestal or other surface.

In assembly, the rod-like members 21 are inserted into the groove 17 and the screws 22 are inserted. Then the bottom panel is mounted to a pedestal and the bottom panel may be fastened to the pedestal by screws through apertures 25. Two side panels are placed in groove 17 adjacent the same corner post and temporarily held together by a piece of masking tape. Then, a third side panel is placed in groove 17 and taped to an adjacent panel and the fourth side panel is secured in the same manner. Then the object(s) to be displayed are positioned in the case. The top panel is then positioned to receive the upper edges of the side panels and rods 21. A screw **22*a* is fastened as tight as possible into one rod 21, and the other screws 22*a* are then screwed into the other rods 21. The upper and lower panels, with the aid of the grooves 17 and 18**, hold the side panels in compression, thus providing a rigidized structure.

Figure 3:
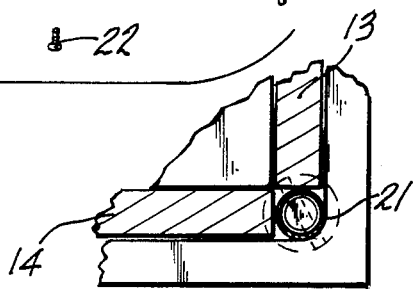
FIG. 3 is a view seen in the plane of lines 3—3 of FIG. 1.

FIG. 3 shows the relation of the rods 21 to the side panels as exemplified by panels 13 and 14. It is preferred that the rod 21 tangentially engage the vertical edges of the side panel and create a substantial seal therewith.

When it is desired to demount the case 10, the assembly described above is reversed for disassembly.

The bottom panel may or may not be transparent, although for purposes of manufacture, it may be preferable to insure that groove 17 has the same dimensions as groove 18 in top panel 12.

In viewing, the rods 21 are almost unnoticeable due to the sizing thereof and the positioning with respect to the vertical edges of the side panels.

While the rod 21 is shown as being threaded at both ends, it may be threaded at the lower end, thus requiring only the upper screws **22*a*. The grooves 17 and 18 are preferably formed by a continuous routing operation in methyl methacrylate (Plexiglas) or acrylic. This will produce a 90° radius at the corner of a dimension equal to the radius of the cutting tool. The apertures 19 and 20 in the corners are countersunk to receive the heads of screws 22 and 22***a*. It is within the scope of the invention to make four different passes to define the grooves 17 and 18. The cuts for the grooves 17 and 18 may bleed to the edges of the top and bottom panels.

In a preferred form, the top and bottom panels are three-eigths inch thick, and the grooves 17 and 18 are cut to tightly receive side panels three-sixteenths inch thick. The rods 21 are three-sixteenths inch outside diameter and the same height as the side panels in the illustrated embodiment. The rods 21 will extend into the grooves at the radius corner. This construction provides an almost unobstructed view of the contents of the display case.

It may thus be seen that the objects of the invention are efficiently obtained. Since modifications to the disclosed embodiment of the invention, as well as other embodiments thereof, may occur to those skilled in the art, the appended claims are intended to cover all modifications of the disclosed embodiment of the invention as well as other embodiments which do not depart from the spirit and scope of the invention.

What is claimed is:

1. A demountable display case comprising upper and lower panels, at least said upper panel being transparent, a continuous groove of essentially rectangular shape defined in the facing surfaces of each of said upper and lower panels, first and second surfaces of each of said upper and lower panels, first and second pairs of rectangular transparent side panels, said first pair of side panels being dimensioned to fit in opposite sides of said groove and define two opposite sides of said case, said second pair of side panels being dimensioned to fit in the other opposite sides of said groove and define the other two opposite sides of said case, and four securing means at the corners of said grooves and compressively holding said side panels in said grooves in said upper and lower panels, said securing means comprising rod-like members which substantially abut the vertical edges of said side panels, and means at each end of said rod members engaging said top and bottom panels said rod-like members being substantially the same dimension in diameter as the thickness of said side panels.

2. The display case of claim 1 where said four side panels are of equal dimensions.

3. The display case of claim 1 where one pair of said side panels is longer than the other pair.

4. The display case of claim 1 where said rod-like members are the same length as the height of the side panels.

5. The display case of claim 1 where said grooves have radius corners and the ends of said rod-like members extend into said grooves at the radius corner.

6. The display case of claim 1 where said rod-like members tangentially abut the vertical edges of said side panels.

* * * * *